US007946571B2

(12) United States Patent
Weiss

(10) Patent No.: US 7,946,571 B2
(45) Date of Patent: May 24, 2011

(54) METHOD FOR CONTROLLING THE FEED OF SHEETS TO A SHEET-FED PRINTING PRESS

(75) Inventor: Hans-Peter Weiss, Wiener Neudorf (AT)

(73) Assignee: Koenig & Bauer AG, Wurzburg (DE)

( * ) Notice: Subject to any disclaimer, the term of this patent is extended or adjusted under 35 U.S.C. 154(b) by 271 days.

(21) Appl. No.: 12/288,087

(22) Filed: Oct. 16, 2008

(65) Prior Publication Data

US 2009/0108515 A1 Apr. 30, 2009

(30) Foreign Application Priority Data

Oct. 31, 2007 (DE) ..... 10 2007 051 945

(51) Int. Cl.
*B65H 5/00* (2006.01)

(52) U.S. Cl. ..... 271/10.01; 271/258.01

(58) Field of Classification Search ..... 271/10.01, 271/11, 256, 265.01, 258.01, 276, 4.01, 5, 271/6; 101/232; 399/393
See application file for complete search history.

(56) References Cited

U.S. PATENT DOCUMENTS 5,626,077 A * 5/1997 Muller ..... 101/484

FOREIGN PATENT DOCUMENTS

| | | | |
|---|---|---|---|
| DE | 19505560 | C2 | 8/1996 |
| DE | 10216135 | A1 | 10/2003 |
| EP | 1281647 | A2 | 2/2003 |
| EP | 1352742 | A1 * | 10/2003 |

* cited by examiner

*Primary Examiner* — Michael C McCullough
(74) *Attorney, Agent, or Firm* — Goodwin Procter LLP

(57) ABSTRACT

A method for controlling the feed of sheets to a sheet-fed printing press is provided for a sheet feeder unit comprising an individual drive assigned to each of a plurality of components provided for supplying the sheets in a stack, separating the sheets from a stack and supplying the sheets to the press. The method includes stopping at least two of the individual drives in a predefined position in a targeted manner when shutting down the feeder unit. The individual drives are operated in synchronization with one another during printing operation. The synchronization between the at least two individual drives is canceled when the sheet feeder unit is shut down. These drives are shut down individually and synchronized with one another when the sheet feeder unit is started up again such that in shutdown, each individual drive assumes a predefinable position.

5 Claims, 1 Drawing Sheet

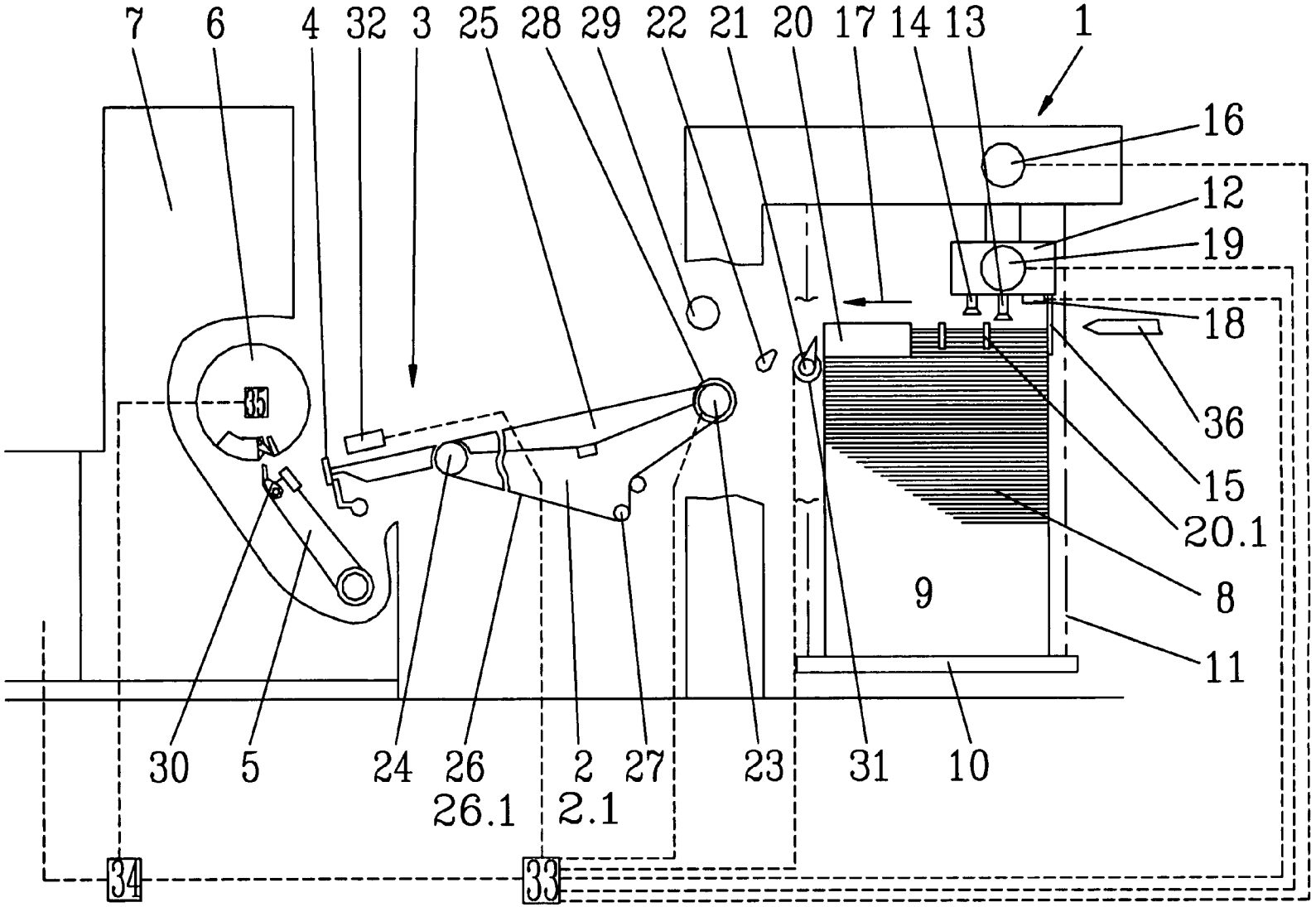
1
16
12
19
18
36
15
20.1
8
11
13
14
17
20
21
22
29
28
25
3
32
4
6
7
10
9
31
23
27
2
2.1
26
26.1
24
5
30
33
34
35

METHOD FOR CONTROLLING THE FEED OF SHEETS TO A SHEET-FED PRINTING PRESS

CROSS-REFERENCE TO RELATED APPLICATIONS

This application claims priority to German Patent Application Serial No. 102007051945.3 filed Oct. 31, 2007, the entirety of which is incorporated herein by reference thereto.

BACKGROUND

The invention relates to a method for controlling the feed of sheets to a sheet-fed printing press having a sheet feeder comprising multiple components, each component being assigned an individual drive and these components being provided for supplying the sheets in a sheet stack, for separating the sheets from a sheet stack and for feeding the sheets to the sheet-fed printing press.

DE 195 05 560 A1 discloses a method for controlling the sheet feed in a sheet processing printing press. In this printing press, the sheets to be printed are taken from the top of a feeder unit stack and conveyed to the installation of the printing press over a predefined conveyor path. At the beginning of the conveyor path, a sheet inspection is performed with regard to double sheets and defective sheets and the sheet conveyance is stopped, depending on the result of the sheet inspection. On detection of a double sheet or defective sheet, withdrawal of additional sheets from the feeder unit stack is stopped immediately and the number of sheets that can still be conveyed into the printing press and printed there before the double sheet or defective sheet in the direction of sheet on the conveyor path reaches the front mark of the installation conveyance is determined. The ink feed is stopped even before the last sheet situated upstream from the double sheet or defective sheet in the direction in conveyance of the sheet enters the printing press. After withdrawal of a sheet from the feeder unit stack has been stopped, sheet conveyance is stopped exactly when the double sheet or defective sheet has reached the installation. Then the number of sheets yet to be fed into the printing press is determined from the distance between the installation and the sheet inspection in combination with the degree of underfeeding in the case of underfed sheet feeding and the format length of the sheets.

One disadvantage of this approach is that in shutdown of the sheet conveyor belt, the underfed sheets may be displaced with respect to one another and cannot approach the printing press again in this state without problems.

EP 1 281 647 B1 therefore presents a method for conveying sheets in a sheet feeder unit of a sheet processing machine by means of which this disadvantage is to be avoided. With this printing press, the rate of travel of the conveyor belt for conveying the fed sheets is variable, independent of the operating speed of the machine in accordance with the predefined speed profiles, so that when starting or stopping of the feeder unit, the conveyor belt can be stopped and/or started in accordance with a predetermined acceleration profile.

DE 102 16 135 A1 discloses a method for controlling the sheet feed to a sheet processing machine having a sheet feeder unit which comprises, among other things, a sheet separator for separating the sheets from a stack and a table with belts or a suction table with belts. The sheets are conveyed to the machine and inspected with regard to double sheets, defective sheets or skewed sheets. If there is such a sheet or if there is a disturbance in the downstream machine, the sheet feed is stopped, in which a sampling device that detects the height level of the stack is provided and the drive of the sheet feeder unit is provided by individual drives, which are controlled by means of an electronic processing unit that is connected to a control unit of the downstream machine. After breaking the connection between the electronic processing unit and the machine control unit, the synchronization of the individual drives is eliminated, so that the individual drives can be operated at will. The individual drives may also be operated optionally in different directions of rotation or brought to a standstill.

This process takes places directly on stoppage of the feeder unit. The disadvantage here is that other driven components of the feeder unit are stopped in an undefined position which makes renewed startup difficult.

Therefore, the object of the present invention is to develop a method by means of which at least two drives of components of the feeder unit are brought to a standstill in a defined position in a targeted manner when the feeder unit is shut down.

SUMMARY

According to the invention, this object is achieved by a method for controlling the feed of sheets to a sheet-fed printing press with a sheet feeder unit comprising multiple components such that these components are provided for supplying the sheets in a stack for separating the sheets from the stack and for conveying the sheets to the feeder printing mechanism of the sheet-fed printing press. An individual drive is assignable to each of these components. These individual drives are operable in synchronization with one another during the printing by the sheet-fed printing press. The synchronization between at least two individual drives is eliminated when the sheet feeder is shut down, wherein these individual drives are shut down individually and synchronized in relation to one another again in resuming operation of the sheet feeder unit such that they assume a predefinable position for each individual drive when the individual drives are shut down.

The invention has the advantage that an optimal stop point is achieved for the components of the sheet feeder so that operation can be resumed without problems.

The invention will now be explained in greater detail below on the basis of an exemplary embodiment.

BRIEF DESCRIPTION OF THE DRAWINGS

FIG. 1 shows a sheet-fed printing press formed in accordance with the present invention.

DETAILED DESCRIPTION OF THE EMBODIMENTS

The respective drawing shows a sheet feeder unit 1 with a table with belts 2. The table with belts 2 is designed as a suction table with belts 2.1. The inventive approach is explained on the example of a sheet feeder unit 1 with a suction table with belts 2.1, in which sheets 8 are held by vacuum on suction belts 26.1, such that the inventive approach may also be implemented on a sheet feeder unit 1 with a table with belts 2 in which the sheets 8 are guided in a known way through pressure rollers arranged on a rod grating against conveyor belts 26 of the table with belts. A feeder table 3 with front marks 4, a vibrating system 5 and a feed cylinder 6 of a feed printing mechanism 7 of a sheet-fed printing press are arranged downstream from the suction table with belts 2.1.

The sheet feeder unit 1 consists of multiple components, each component being assigned an individual drive 19, 28, 31.

A stack 9 consisting of the sheets 8 is positioned on a stack plate 10 in the sheet feeder unit 1. The stack plate 10 is attached to conveyor means 11, which are connected to a lift (not shown). A sheet separator 12 is assigned as an additional component to the top of the stack 9. The sheet separator 12 has separation suction cups 13 and conveyor suction cups 14 as well as undercut edge stops 15. The sheet separator 12 is provided so that it is adjustable in height by means of an actuator drive 16 in the sheet feeder unit 1. In addition, the sheet separator 12 may be displaced in or against a direction of conveyance 17 for adaptation of the format. In the exemplary embodiment, a sampling device 18 is assigned to the sheet separator 12 to detect the height level of the stack 9. The sampling device 18 may also be provided at any other location on the sheet feeder unit 1. The sheet separator 12 is driven by means of a first individual drive 19, which may be designed as an electric motor, for example. Blowers 36 are also provided on the rear side and optionally on the sides of the stack 9 for predrying the sheets 8 on the stack 9 and for blowing under the sheets 8 during conveyance. To be able to form an air cushion that will support the sheets 8, side plates 20 are arranged on the sides of the stack 9. However, it is also possible to assign laterally bordering guide elements 20.1 to the stack 9.

On the front side of the stack 9, a shaft 21 extends over the width of the stack 9 as an additional component of the sheet feeder unit 1, its drive being provided by a third individual drive 31. Downstream from this a blow pipe 22 whose direction of blowing runs approximately opposite a direction of conveyance 17.

The suction table with belts 2.1 as an additional component of the sheet feeder unit 1 comprises a drive roller 23 and a reversing roller 24, between which a suction box 25 is provided, at least one suction belt 26.1 being wrapped around the rollers 23, 24. The suction belt 26.1 is put under tension by tension rollers 27. The suction belt 26.1 is provided with suction openings in a known way, coming into operative connection with suction bores provided in the suction box 25 in their movement in the direction of conveyance 17, driven by the drive roller 23. The drive roller 23 is driven by a second individual drive 28, e.g., an electric motor. Stepping wheels 29 correspond to the drive roller 23 and are controlled periodically against the drive roller 23 within an operating cycle.

The front marks 4 are controlled into an operating position against the feeder table 3 downstream from the suction table with belts 2.1 from a catch position beneath the feeder table 3. An inspection device 32 is provided for the feeder table 3. The vibrating system 5 arranged downstream from the feeder table 3 has a sheet holding system 30 and executes a pivoting movement between the feeder table 3 and the feeder cylinder 6 of the feeder printing mechanism 7.

The individual drives 19, 28, 31 that drive the sheet separator as well as the sheet conveyor means, the actuator drive 16 and the inspection device 32 are connected to an electronic processing unit 33 of the sheet feeder unit 1 which is in turn connected to a control unit 34 of the downstream sheet-fed printing press. The sheet feeder unit 1 is readjusted in synchronization with the sheet-fed printing press via the machine control unit 34 and the electronic process unit 33.

To do so, a rotary angle sensor 35 may be assigned, for example, to the feed cylinder 6, which is connected to the machine control unit 34. The individual drives 19, 28, 31 run in synchronization with one another over 360° of a single-turn shaft as well as within a unit of time.

In synchronized readjustment of the sheet feeder unit 1, the top sheet 8 is separated from the stack 9 by the separating suction cups 13 driven by the first individual drive 19 assigned to the sheet separator 12 and is transferred to the conveyor suction cups 14 which convey the separated sheets 8 in the direction of conveyance 17. The separation of the sheets 8 is supported by the fact that the stack 9 is loosened by blowers 36 and air is blown by the additional blowers 36 under the respective sheets 8 conveyed by the conveyor suction cups 14. The sheets 8 conveyed by the conveyor suction cups 14 are guided by the stepping wheels 29 that make contact in cycles against the drive roller 23 and are then released by the conveyor suction cups 14. The shaft 21 driven by the third individual drive 31 is pivoted out of the path of the sheets 8 and the blowing air feed to the blow pipe 22 is interrupted. The sheets 8 guided by the stepping wheels 29 against the drive roller 23 are picked up by the suction belts 26.1, which are constantly being acted upon by a vacuum via the suction box 26, and then are conveyed as a stack of sheets onto the feeder table 3 and with the front edge toward the front marks 4 in the working position. In the exemplary embodiment, an inspection device 32 which detects the sheets 8 is provided for the feeder table 3. It is also possible to provide multiple measurement devices that inspect the sheets 8 and distribute them over the path of the sheets 8 as they travel from the sheet feeder unit 1 to the front marks 4.

If no sheets 8 that are subject to defects are detected by the inspection device 32, then the sheet 8 in contact with the front marks is transferred by the sheet holding system 30 of the vibrating system 5 and conveyed to the feed cylinder 6 whereby the front marks 4 are pivoted into their position beneath the feeder table 3. If a sheet 8 subject to defects is detected by the inspection device 32, a signal is supplied from the inspection device 32 to the electronic processing unit 33 and the synchronization between at least two individual drives 19, 28,31 is canceled thereby. In the exemplary embodiment, these include the first individual drive 19 and the second individual drive 28. It is also possible to eliminate the synchronization of all individual drives 19, 28, 31.

The individual drives 19, 28 are shut down individually. The conveyor belt 26 is stopped within the shortest possible amount of time in a process that is optimized for acceleration. This takes place in such a way that the conveyor belt 26 experiences a negative acceleration when stopped such that it comes to standstill in a technologically minimal time while maintaining the distance between the sheet 8 of the stack of sheets.

In shutdown of the individual drives 19, 28, they assume a position predefined for each individual drive 19, 28. Thus, for example, the sheet separator 12 moves into a position which allows it to start up again with no problem. The goal here is for the sheet separator 12 to reach this predefinable position within a technologically minimal amount of time. The sheet separator 12 may move in the direction of conveyance 17 or opposite the direction of conveyance 17.

After removing the defective sheet 8 from the feeder table 3, removal of the sheets 8 on the suction table with belts 2.1 is initiated by a startup signal supplied manually to the electronic processing unit 33. In doing so the blowing air and suction air supply to the sheet separator 12 as well as the blowing air supplied to the blowers 36 are interrupted and the blow pipe 22 is acted upon by blowing air.

When the sheet feeder unit 1 is started up again, the first individual drive 19 and the second individual drives 28 are synchronized with one another again. The actuator drive 16 of the sheet separator 12 is lowered into its working position, the suction air and blowing air supplied to the sheet separator 12 and the blowing air supplied to the blowers 36 are activated and the blowing air supplied to the blow pipe 22 is interrupted. At the same time, the individual drives 19, 28 are activated such that the original direction of rotation of the second individual drive 28 is restored, so that the sheets 8 are removed from the stack 9 in the direction of conveyance 17 and can be sent to the front marks 4. After aligning the first sheet 8 with the front marks 4, the connection between the electronic processing unit 33 and the machine control unit 34 is restored and the sheet feeder unit 1 is connected to the suction table with belts 2 within one working cycle.

The present invention is not limited just to the exemplary embodiment described above. Other components of the sheet feeder unit 1, not specified in the exemplary embodiment but provided with individual drives, may be operated in the manner described here.

What is claimed is:

1. A method for controlling feed of sheets to a sheet-fed printing press with a sheet feeder unit (1), said sheet feeder unit comprising multiple components for supplying the sheets (8) in a stack (9) for separating the sheets (8) from the stack (9) and for conveying the sheets (8) to a feeder printing mechanism (7) of the sheet-fed printing press; said method comprising:

providing an individual drive (19, 28, 31) assignable to each of said multiple components; said individual drives (19, 28, 31) operating in synchronization with one another during printing by the sheet-fed printing press;

inspecting said sheets to detect a defect that requires shutting down said sheet feeder;

shutting down said sheet feeder unit in response to detecting said defect, said shutting down comprising eliminating the synchronization between at least two individual drives (19, 28, 31) and shutting down said at least two individual drives individually to assume a predefinable position for each individual drive, wherein said predefinable position is defined such that each of said individual drives (19, 28, 31) is synchronized in relation to each other again upon resuming operation of the sheet feeder unit from said predefinable position.

2. The method for controlling the feed of sheets according to claim 1, characterized in that the predefinable position is reached in a technologically minimal time.

3. The method for controlling the feed of sheets according to claim 1, characterized in that the individual drives (19, 28, 31) are moved in a direction of conveyance (17) of the sheets (8) or opposite the direction of conveyance (17) of the sheets to achieve the predefinable position.

4. The method for controlling the feed of sheets according to claim 1 or 3, characterized in that a sheet separator (12) is provided as one of the components for separating the sheets (8) from the stack (9), and a conveyor belt (26, 26.1) for conveying the sheets (8) in a staggered stack of sheets on a feeder table (3) is provided as another one of the components, such that the individual drives (19, 28) of the sheet separator (12) and of the conveyor belt (26, 26.1) are operated in synchronization to one another during the printing; in shutdown of the sheet feeder unit (1) the conveyor belt (26, 26.1) is stopped for a short period of time in an acceleration-optimized manner, and the sheet separator (12) is moved into a predeterminable position where said sheet separator comes to a standstill.

5. The method for controlling the feed of sheets according to claim 4, characterized in that the conveyor belt (26, 26.1) experiences a negative acceleration when the sheet feeder unit (1) is stopped, such that said conveyor belt comes to a standstill within a shortest possible period of time while maintaining a predetermined distance between the sheets (8) of the sheet stack.

* * * * *